United States Patent [19]

Hawkins

[11] 3,970,305

[45] July 20, 1976

[54] ATHLETIC WRIST SUPPORT

[76] Inventor: Luther M. Hawkins, 3625 Wilkie Way, Fort Worth, Tex. 76133

[22] Filed: May 6, 1975

[21] Appl. No.: 575,019

[52] U.S. Cl. ..... 273/54 B; 128/87 R

[51] Int. Cl.[2] ..... A63B 71/14

[58] Field of Search ..... 273/54 B, 189 A; 128/77, 87 R, 87 C, 88; 2/161 A

[56] References Cited

UNITED STATES PATENTS

| | | | |
|---|---|---|---|
| 1,226,160 | 5/1917 | Allis | 273/189 A |
| 2,767,708 | 10/1956 | Keropian | 128/77 |
| 3,400,934 | 9/1968 | Muehl | 273/189 A |
| 3,707,963 | 1/1973 | Keropian | 128/77 |
| 3,829,090 | 8/1974 | Ensinger | 273/54 B |
| 3,865,383 | 2/1975 | Clay et al. | 273/189 A X |

FOREIGN PATENTS OR APPLICATIONS

| | | | |
|---|---|---|---|
| 105,419 | 4/1917 | United Kingdom | 128/88 |

*Primary Examiner*—Anton O. Oechsle
*Attorney, Agent, or Firm*—Wofford, Felsman, Fails & Zobal

[57] ABSTRACT

An athletic wrist support for attachment to the arm and hand of a player. While in play, the user may adjust the support to a restricting position to restrict movement of the hand and hence flexure of the wrist in the backward direction but to allow movement of the hand in the other three planes. When not playing, the user may adjust the support to a neutral position to allow movement of the hand in all four planes. The wrist support comprises an arm plate and a hand plate pivotally coupled together and adapted to be secured to the top of the arm and hand respectively. The two plates are pivotally coupled together for movement about two different axes to allow movement of the hand plate and hence the hand in all four planes. A stop is slidably coupled to the top of the arm plate and which may be slid to a restricting position above the hand plate for restricting motion of the hand plate and hence the hand in the backward direction. In the neutral position, the stop does not affect movement of the hand plate, thereby allowing movement of the hand in all four planes.

7 Claims, 6 Drawing Figures

69
63
73
26
67
65
71
21
75B
77B 57
55
59
51
33
29
23
59
33
25
75B'
75B
77B

77B'
75A
53
29
52
27

35
75A
35
77B'
77A
41
43
23
29
47
35
27
45

35

ATHLETIC WRIST SUPPORT

BACKGROUND OF THE INVENTION

This invention relates to an athletic wrist support and more particularly to an adjustable athletic wrist support for restricting movement of the hand and hence flexure of the wrist in the backward direction during play.

In certain sports such as bowling, it is desirable to restrict flexure of the wrist in the backward direction to achieve a desired result. Wrist supports for restricting flexure of the wrist in the backward direction, have been proposed however, those known all have certain disadvantages.

SUMMARY OF THE INVENTION

It is an object of the present invention to provide a unique and simple, effective, and economical athletic wrist support for restricting movement of the wrist in the backward direction.

It is a further object of the present invention to provide an athletic wrist support which can be adjusted to the relaxed mode when the contestant is not participating, to allow the wrist to flex in all four planes.

In one embodiment, the wrist support comprises arm means to be secured to the top of one's arm and hand means to be secured to the top of one's hand. First and second pivot means pivotally connect the arm and hand means together for pivotal movement about first and second pivot axes respectively. The first pivot means allows the hand means to pivot to positions above and below the arm means while the second pivot means allows the hand means to pivot to positions to the left and to the right of the arm means. Stop means is provided and which is movable to first and second positions. In the first position, the stop means allows the hand means to pivot to positions to the left and right and above and below the arm means. In the second positon, the stop means allows the hand means to pivot to positions to the left and right and below the arm means but restricts movement of the hand means above the arm means. Means is provided for securing the arm means to the top of one hand and in addition, means is provided for securing the hand means to the top of one hand.

In a further aspect, the stop means is slidably mounted to the top of the arm means for slidable movement to the first position above the arm means rearward of the hand means and to the second position above both the arm and hand means for engagement with the hand means when it is pivoted upward to a given position.

In the embodiment disclosed, the arm means comprises a first plate means and the hand means comprises a second plate means. Holding means is provided for holding the arm and plate means. The holding means comprises an arm portion for holding the arm plate means and a hand portion for holding the hand plate means. Strap means extends from said arm portion for securing said arm portion and hence said arm plate means to the top of one's hand rearward of the wrist. Strap means also extends from said hand portion for securing said hand portion and hence said hand plate means to the top of one's hand forward of the wrist.

BRIEF DESCRIPTION OF THE DRAWINGS:

FIGS. 3–5 illustrate the top sides of the two plates while FIG. 6 illustrates the underside of the two plates. The arm plate includes an adjustable stop which is located in a neutral position in FIGS. 3 and 4 in a restricting position in FIG. 5.

Figures 1, 2, 3, 4, 5, 6:
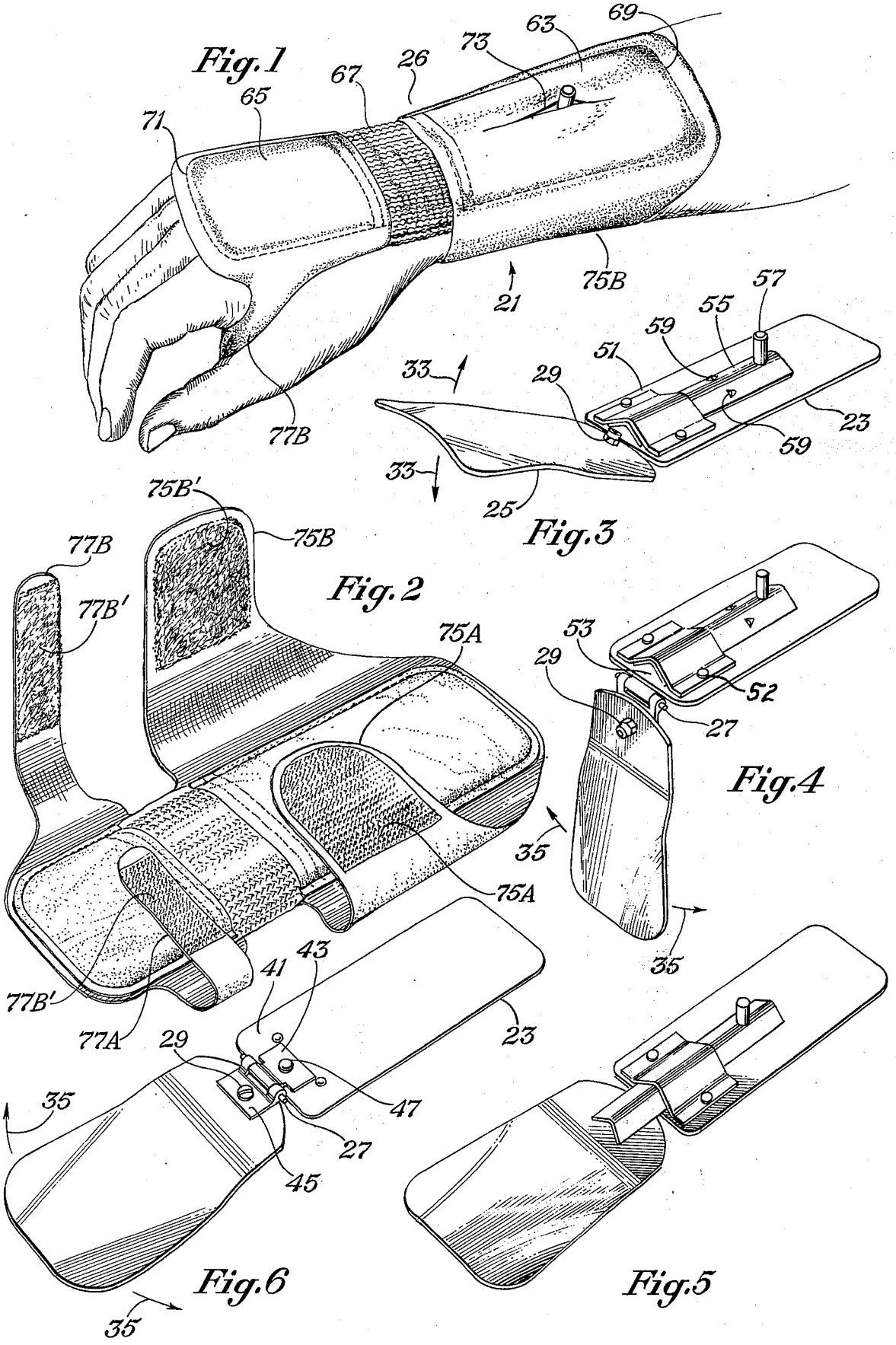
FIG. 1 illustrates the athletic wrist support of the present invention secured to the arm and hand of a person.
FIG. 2 illustrates the underside of the athletic wrist support of FIG. 1.
FIGS. 3–6 illustrate an arm plate and a hand plate pivotally coupled together for movement about two different axes and which are inserted in a pocket formed in the holder of FIGS. 1 and 2.

DETAILED DESCRIPTION OF THE INVENTION:

Referring now to the drawings, the athletic wrist support of the present invention is identified at 21. It comprises an arm plate 23 adapted to be secured to the top of one's arm and a hand plate 25 adapted to be secured to the top of one's hand. A holder 26 is provided for holding the two plates and for securing the two plates to the top of the arm and hand respectively, as will be described subsequently. The two plates 23 and 25 are pivotally connected together by way of pivot members 27 and 29. Pivot member 27 allows plate 25 to pivot to positions above and below plate 23 while pivot member 29 allows plate 25 to pivot to positions to the left and right of plate 23. Pivotal movement about pivot member 27 may be in the direction of arrows 33 while pivotal movement about pivot member 29 may be in the direction of arrows 35.

As illustrated in FIG. 6, pivot member 27 is the pivot pin of a hinge 41 having two plates 43 and 45 pivoted together by pin 27. Hinge plate 43 is fixedly secured to arm plate 23 by way of rivet 47 while hand plate 25 is pivotally coupled to hinge plate 45 by pivot member 29. In the embodiment disclosed, pivot member 29 is formed by a bolt and a nut.

Fixedly attached to the top of plate 23 is a V-shaped guide 51 forming an opening 53 for slidably receiving an elongated stop 55. Stop 55 may be alid to a rearward neutral position, as illustrated in FIGS. 3 and 4 or to a forward restricting position, as illustrated in FIG. 5. A handle 57 extending upward from stop 55 is provided for facilitating movement of the stop 55. Projections 59 limit forward movement of the stop 55. In the neutral position, stop 55 is located above plate 23 and completely rearward of hand plate 25 and hence does not interfere with pivotal movement of plate 25 about pivot means 27 and 29, thereby allowing the hand plate to pivot in all four planes. In the restricting position, the front portion of stop 55 is located above hand plate 25, as illustrated in FIG. 5, and will restrict upward movement of plate 25 when it is moved upward to engage the stop 55. In this position, the stop 55 will not affect downward movement of the plate 25 nor sideward movement to the left and right.

The holder 26, forming the wrist support, comprises an arm portion 63 and a hand portion 65 interconnected by way of an intermediate resilient portion 67. The holder 26 has a pocket extending between points 69 and 71 for holding the plates 23 and 25. The arm portion 63 has an elongated slit 73 formed in its top whereby the plates 25 and 23 may be inserted into the pocket. In the insertion step, plate 25 is inserted first and slid forward to the front end of the pocket defined by the hand portion 65. In this position, the arm plate 23 will be located in the portion of the pocket defined by the arm portion 63 with handle 57 projecting through the slit 73, as illustrated. The slit 73 allows the handle 57 to be moved forward or rearward to position the stop 55 in the restricting or neutral position. It also acts to limit rearward movement of the handle 57 and hence of the stop 55. The hinge 41 and pivot members 27 and 29 will be located in the portion of the pocket defined by the resilient intermediate portion 67.

Arm portion 63 includes straps 75A and 75B for securing the arm portion and hence the arm plate 23 to the top of the arm while hand portion 65 includes straps 77A and 77B for securing the hand portion and hence the hand plate 25 to the top of the hand. Straps 75A, 75B and 77A and 77B have hook and loop fasteners identified by the trademark VELCRO to allow the straps to be rapidly attached together and detached to facilitate attachment and removal of the wrist support. The hooks are identified at 75A' and 77A' while the loop fasteners are identified at 75B' and 77B'.

When the wrist support is secured in place, plate 23 will be secured to the top of the arm while plate 25 will be secured to the top of the hand. Pivot members 27 and 29 will be located generally above the wrist. If the wrist support is being used by a bowler, it will be secured to the arm and hand, as indicated above, and the bowler will move the handle 57 and hence stop 55 to a forward or restricting position while in the process of bowling. In the restricting position, the bowler will be able to move his hand in three planes, i.e., down and to the left and right but will not be able to move his hand upward beyond the point where plate 25 engages stop 55. Thus, the bowler will not be able to flex his wrist in the backward direction thereby facilitating bowling in the desired manner. After each play, while waiting for the next contestant to perform, the bowler may achieve free movement of the hand in all four planes by moving the handle 57 and hence the stop 55 rearward to its neutral position.

In the embodiment disclosed, the arm and hand portions 63 and 65 of the holder 26 are formed of a tough flexible cloth while the intermediate portion 67 is formed of a material having resilient strands such as rubber to allow the intermediate portion 67 to readily stretch and flex, as desired when the wrist support is attached to the person's arm and hand. The guide 51 is fixedly attached to plate 23 by way of rivets 52.

In another embodiment, the stop 55 may be fixedly secured to plate 23 in the restricting position shown in FIG. 5. In this embodiment, the stop 55 will always restrict upward movement of plate 25 but will not affect downward movement of the plate 25 nor sideward movement to the left or right. The stop 55 may be fixedly secured to plate 23 in the position shown in FIG. 5 by welding or by the use of rivets. In this embodiment guide 51 and handle 57 will not be needed. Although this embodiment has disadvantages from the standpoint of flexibility, it has advantages from the standpoint of economics.

I claim:

1. An athletic wrist support comprising:

arm means to be secured to the top of one's arm, hand means to be secured to the top of one's hand, first and second pivot means for pivotally connecting said arm and hand means together for pivotal movement about first and second pivot axes respectively, said first pivot means allowing said hand means to pivot to positions above and below said arm means, said second pivot means allowing said hand means to pivot to positions to the left and right of said arm means, stop means movable to first and second positions, said stop means in said first position allowing said hand means to pivot to positions to the left and right and above and below said arm means, said stop means in said second position, allowing said hand means to pivot to positions to the left and right and below said arm means but restricting movement of said hand means above said arm means, means for securing said arm means to the top of one's arm, and means for securing said hand means to the top of one's hand.

2. The athletic wrist support of claim 1 wherein:

said stop means is slidably mounted to the top of said arm means for slidable movement to said first position above said arm means rearward of said hand means and to said second position above said arm means and said hand means for engagement with said hand means when it is pivoted upward to a given position.

3. The athletic wrist support of claim 2 wherein:

said means for securing said arm means to the top of one's arm comprises strap means for securing said arm means to the top of one's arm rearward of the wrist, said means for securing said hand means to the top of one's hand comprises strap means for securing said hand means to the top of one's hand forward of the wrist.

4. The athletic wrist support of claim 2 wherein:

said arm means comprises an arm plate means, said hand means comprises a hand plate means.

5. The athletic wrist support of claim 4 comprising:

hinge means having first and second members hinged together by said first pivot means, said first member being secured to said arm plate means, said second member being pivotally coupled to said hand plate means by said second pivot means.

6. The athletic wrist support of claim 4 comprisng:

holding means for holding said arm and plate means, said holding means comprising an arm portion for holding said arm plate means and a hand portion for holding said hand plate means, strap means extending from said arm portion for securing said arm portion and hence said arm plate means to the top of one's arm rearward of the wrist, and strap means extending from said hand portion for securing said hand portion and hence said hand plate means to the top of one's hand forward of the wrist.

7. An athletic wrist support comprising:

arm means including arm plate means to be secured to the top of one's arm, hand means including hand plate means to be secured to the top of one's hand, hinge means having first and second members hinged together by a first pivot means, said first member being secured to said arm plate means, said second member being pivotally coupled to said hand plate means by a second pivot means, said first pivot means allowing said hand means to pivot to positions above and below said arm means, said second pivot means allowing said hand means to pivot to positions to the left and right of said arm means, stop means secured to said arm plate means and having a portion extending above said hand plate means for allowing said hand means to pivot to positions to the left and right and below said arm means but restricting movement of said hand means above said arm means, means for securing said arm means to the top of one's arm, and means for securing said hand means to the top of one's hand.

* * * * *